US006010469A

United States Patent [19]

McAtee

[11] Patent Number: 6,010,469

[45] Date of Patent: Jan. 4, 2000

[54] HAND MASSAGE TOOL

[76] Inventor: Robert E. McAtee, 1119 N. Wahsatch, #1, Colorado Springs, Colo. 80903

[21] Appl. No.: 08/819,506

[22] Filed: Mar. 17, 1997

[51] Int. Cl.[7] ..... A61H 7/00

[52] U.S. Cl. ..... 601/135; 601/137; 601/138; 601/141

[58] Field of Search ..... 601/134–139, 601/141; 482/49

[56] References Cited

U.S. PATENT DOCUMENTS

| | | | |
|---|---|---|---|
| D. 85,076 | 9/1931 | Barker | 601/137 X |
| 1,872,832 | 8/1932 | Silverberg | 601/141 |
| 2,221,363 | 11/1940 | Sweatt | 601/141 X |
| 4,205,664 | 6/1980 | Baccialon | 601/141 |
| 4,483,328 | 11/1984 | Wolocko | 601/135 |
| 5,624,384 | 4/1997 | Chen | 601/135 X |
| 5,624,385 | 4/1997 | Hwang | 601/135 |

FOREIGN PATENT DOCUMENTS

| | | | |
|---|---|---|---|
| 120094 | 11/1930 | Austria | 601/141 |
| 2637496 | 4/1990 | France | 601/135 |

*Primary Examiner*—Danton D. DeMille
*Attorney, Agent, or Firm*—G. F. Gallinger

[57] ABSTRACT

A massage tool with which a professional massager can apply the full force generated by their arm to a precise body area, without any finger or wrist stress, even over indefinitely prolonged periods is disclosed. The massage tool comprises: an elongate handle member adapted to lay across the palm of a hand and be encircled by the fingers; a first leg member extending outwardly from one end portion of the elongate handle member; a first foot member extending from the outward end portion of the first leg member in a direction lateral to, and away from the palm of the hand. The foot member has a length exceeding the thickness of the thumb and has a heel portion, side portions, and an outside end portion all of which are adapted for rubbing. The leg member is generally the length of the thumb so that the inner side of the thumb may lay along the front side portion of the leg member and the end of the thumb may press against the top side portion of the foot member. In a preferred embodiment the massage tool includes a second leg member and foot member so that one can rub with either the foot in the heel of one's hand or with the foot positioned adjacent to one's thumb. Most preferably the tool is made of ceramic.

17 Claims, 1 Drawing Sheet

HAND MASSAGE TOOL

FIELD OF INVENTION

This invention relates to non-mechanized tools used to massage the body. More particularly this invention relates to a massage tool with which a professional massager can apply the full force generated by their arm to a precise body area, without any finger or wrist stress, even over indefinitely prolonged periods.

BACKGROUND OF THE INVENTION

The inventor is a professional sports massage therapist. Continuous massaging stresses both the fingers and the wrist. Accordingly, he experimented with massage tools generally available. One problem with the massage tools is that they were not comfortable to hold and manipulate. With them it was difficult to deeply massage large areas using only the large arm muscles without transmitting force through the wrist and hand.

Another problem with these massage tools was that they were difficult to manipulate to massage a precise body area such as a myofascial trigger point. One frequently lacked too large of a degree of control to most optimally, and efficiently massage selected muscles. Another problem was that they had a high coefficient of friction against the body. Plastic tools, when they heat with friction, become stickier, pulling both the skin and any hair growing therefrom.

OBJECTS AND STATEMENT OF INVENTION

It is an object of this invention to disclose a massage tool which is extremely comfortable to hold a massage tool with an elongate handle which comfortably fits within the palm of the hand. It is an object of this invention to disclose a massage tool with which it is possible to massage large body areas transmitting a significant amount of the arm's force without placing undue stress on either the hand or the wrist. It is yet a further object of this invention to disclose a massage tool which facilitates optimal and efficient massage of a selected muscle. A massage tool which allows one the control, to transmit a measured force to a selected side of even a small muscle; to vary the area of the pressing surface; and, to utilize different muscles while massaging. It is yet a further object of this invention to disclose a massage tool material which is highly slippery, even when hot with friction, and which is non-slippery on its gripping surface even when coated with a massage oil. It is a final object of this invention to disclose a massage tool material which can be readily formed and is much preferred by holistic practitioners to plastic or wood because of its ability to transmit etheric energy.

One aspect of this invention provides for a massage tool comprising: an elongate handle member adapted to lay across the palm of a hand and be encircled by the fingers; a first leg member extending outwardly from one end portion of the elongate handle member; and, a first foot member extending from the outward end portion of the first leg member in a direction lateral to, and away from the palm of the hand, and having a length exceeding the thickness of the thumb.

Another aspect of this invention provides for a massage tool as above wherein the foot member has a heel portion, side portions, and an outside end portion all of which are adapted for rubbing therewith; and, the leg member is generally the length of the thumb so that the inner side of the thumb may lay along the front side portion of the leg member and the end of the thumb may press against the top side portion of the foot member.

Yet another aspect of this invention provides for a massage tool as above further comprising a second leg member extending outwardly from the other end portion of the elongate handle member in a direction generally opposite to the first leg member and a second foot member extending from the outward end portion of the second leg member in a direction which is lateral to and away from the palm of the hand, and having a length exceeding the thickness of the thumb.

Various other objects, advantages and features of novelty which characterize this invention are pointed out with particularity in the claims which form part of this disclosure. For a better understanding of the invention, its operating advantages, and the specific objects attained by its users, reference should be made to the accompanying drawings and description, in which preferred embodiments of the invention are illustrated.

FIGURES OF THE INVENTION

The invention will be better understood and objects other than those set forth will become apparent to those skilled in the art when consideration is given to the following detailed description thereof. Such description makes reference to the annexed drawings wherein.

Figure 1:
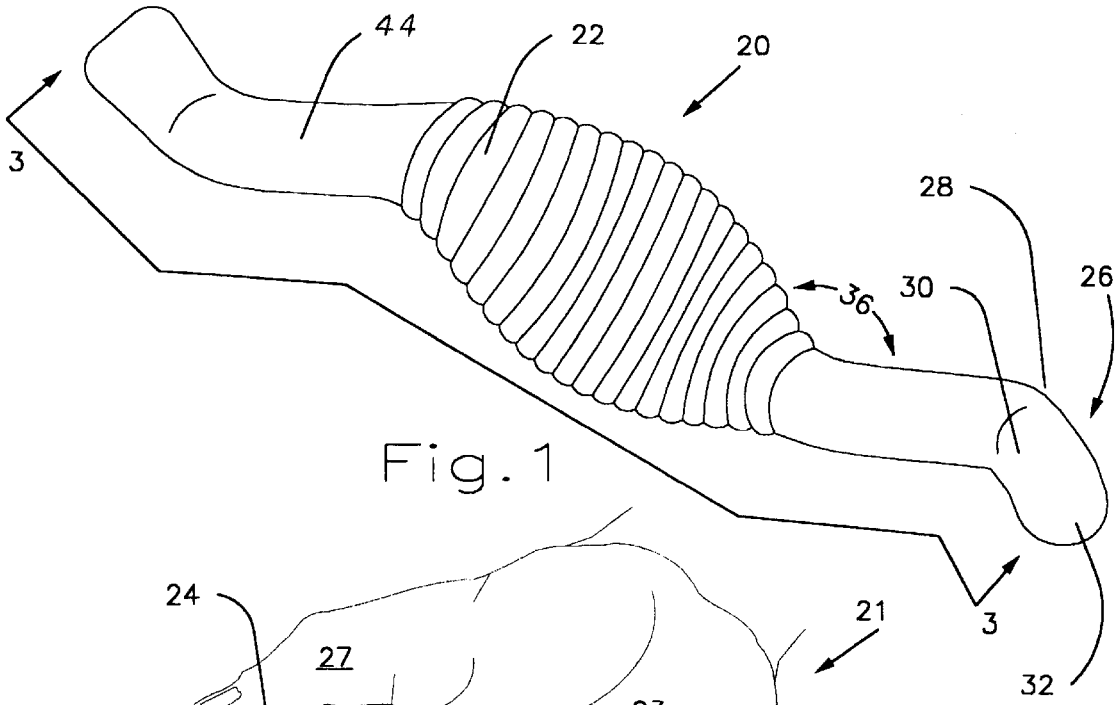
FIG. 1 is a perspective view of a massage tool.

The following is a discussion and description of the preferred specific embodiments of this invention, such being made with reference to the drawings, wherein the same reference numerals are used to indicate the same or similar parts and/or structure. It should be noted that such discussion and description is not meant to unduly limit the scope of the invention.

DESCRIPTION OF THE INVENTION

Figure 2:
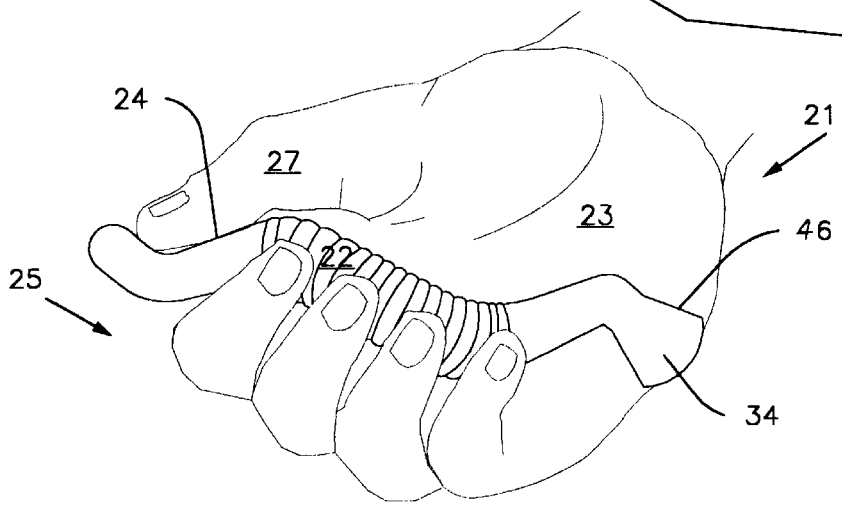
FIG. 2 is a perspective view of the massage tool gripped in a hand.

Turning now to the drawings and more particularly to FIG. 1 we have a perspective view of a massage tool 20. FIG. 2 is a perspective view of the massage tool 20 gripped in a hand 21. The massage tool 20 comprises: an elongate handle member 22 adapted to lay across the palm of a hand 23 (shown in FIG. 2) and be encircled by the fingers 25; a first leg member 24 extending outwardly from one end portion of the elongate handle member 22; and, a first foot member 26 extending from the outward end portion of the first leg member 24 in a direction lateral to, and away from the palm of the hand 23, and having a length exceeding the thickness of the thumb 27.

The foot member 26 has a heel portion 28, side portions 30, and an outside end portion 32 all of which are adapted for rubbing therewith. The leg member 24 is generally the length of the thumb 27 so that the inner side of the thumb 27 may lay along the front side portion of the leg member 24 and the end of the thumb 27 may press against the top side portion of the foot member 26. The preferred embodiment of the invention includes a second leg member 44 extending outwardly from the other end portion of the elongate handle member 22 in a direction generally opposite to the first leg member 24 and a second foot member 46 extending from the outward end portion of the second leg member 44 in a direction which is lateral to and away from the palm of the hand 23, and having a length exceeding the thickness of the thumb 27.

Most preferably the foot members 26, 46 have differing shapes and sizes to facilitate rubbing with differing pressures and penetration. The foot members 26, 46 extend generally parallel to the elongate handle member 22. One foot member 26 is generally the shape and size of an end of a finger 25. The end of the other foot member 46 may have an enlarged mushroom shaped end portion 34 for large area massage.

The most preferred embodiment of the invention includes both functional and aesthetic features. The leg members 24, 44 extend parallel to each other. The angle 36 formed between each leg member 24 and the elongate handle member 22 is an obtuse angle and the elongate handle member 22 is generally shorter than the width of the hand 27.

Figure 3:
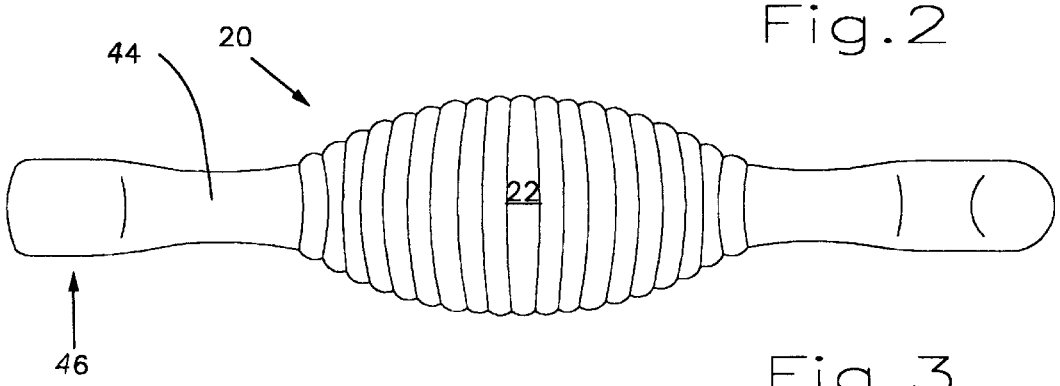
FIG. 3 is a bottom view of the massage tool taken along on 3—3 on FIG. 1.

FIG. 3 is a bottom view of the massage tool taken along on 3—3 on FIG. 1. Most preferably the elongate handle member 22 has a generally elliptical cross section to facilitate holding without rolling. The elongate handle member 22 has an enlarged central portion which gradually diminishes towards its end portions. The elongate handle member 22 may also be ribbed to facilitate gripping. In the most preferred embodiment the massage tool 20 is made from a ceramic material. The foot members 26, 46 are glazed to maximize smoothness and thereby minimize rubbing friction whereas and the handle member 22 is not glazed to minimize slipping while gripping. The ceramic material may contain a strengthening compound such as aluminum oxide.

The massage tool 20 is used in multiple positions. When it is longitudinally rotated 180 degrees in the hand 27 its rubbing surface area is changed. In addition to rubbing with the end portion 32 and heel portions 28 of the foot members 26, 46 one may rub with the side portions 30 thereof. This may be in conjunction with the side portions of the legs 24, 44. Even the top portion of the foot member 26 is useful to rub the bottom of a person's foot (not shown). Typically the second foot member 46 is wider than the other round, more pointed foot member 26. The pointed foot member 26 is useful for myofascial trigger points, and the laminar grooves adjacent to the spine (not shown) as well as deep penetration of smaller muscles.

The ceramic massage tool 20 does not harbour bacteria like a wood or plastic massage tool 20. It is more hygienic. It facilitates more precisely directed control of a measured force with minimal wrist or finger strain. Rubbing with a foot member 26, 46 positioned under the heel of one's hand 27 allows one to transmit full large muscle arm force without any wrist or finger strain even over a prolonged period.

While the invention has been described with preferred specific embodiments thereof, it will be understood that this description is intended to illustrate and not to limit the scope of the invention. The optimal dimensional relationships for all parts of the invention are to include all variations in size, materials, shape, form, function, assembly, and operation, which are deemed readily apparent and obvious to one skilled in the art. All equivalent relationships to those illustrated in the drawings, and described in the specification, are intended to be encompassed in this invention. What is desired to be protected is defined by the following claims.

I claim:

1. A massage tool conmprising:

an elongate handle member adapted to lay across the palm of a hand and be closely encircled by all of the fingers in the hand;

a first elongate leg member angling obliquely away from one end portion of the elongate handle member;

a first foot member extending away from the outward end portion of the first leg member in the same general direction as the handle member; and, the foot member has a heel portion, side portions, and an outside end portion all of which are adapted for rubbing massage therewith;

configured so that one's thumb may lay flat and continuously along the leg member and an end portion of one's thumb would press against a top portion of the foot member when massaging with a bottom side portion of the foot member.

2. A massage tool as in claim 1 wherein the leg member is adapted so that the inner side of the thumb may lay along the front side portion of the leg member and the end of the thumb may press against the top side portion of the foot member.

3. A massage tool as in claim 2 wherein the elongate handle member has a generally elliptical cross section to facilitate holding without rolling.

4. A massage tool as in claim 1 further comprising a second elongate leg member angling obliquely away from the other end portion of the elongate handle member in a direction generally opposite to the first leg member.

5. A massage tool as in claim 4 further comprising a second foot member, having a heel portion, side portions and an outside end portion thereof all of which are adapted for rubbing massage therewith, extending away from the outward end portion of the second leg member in the same general direction as the handle member so that when the handle portion is held in a palm of one's hand, closely encircled by all of the fingers in the hand, and when a heel of one's hand is laid along the second leg and foot member, one may rub forcefully with the second foot member, not transmitting through one's fingers but with the full strength of one's arm.

6. A massage tool as in claim 5 wherein the foot members have differing shapes and sizes to facilitate rubbing with differing pressures and penetration.

7. A massage tool as in claim 5 wherein the foot members extend generally parallel to the elongate handle member.

8. A massage tool as in claim 7 wherein one foot member is adapted to have the general shape and size of an end of a finger.

9. A massage tool as in claim 8 wherein the leg members extend parallel to each other.

10. A massage tool as in claim 9 wherein the angle formed between each leg member and the elongate handle member is an obtuse angle and the elongate handle member is generally shorter than the width of the hand.

11. A massage tool as in claim 10 wherein the elongate handle member is roughened and ribbed to facilitate non-slip gripping.

12. A massage tool as in claim 7 wherein one foot member has an enlarged mushroom shaped end portion for large area massage.

13. A massage tool as in claim 1 which is made from a ceramic material.

14. A massage tool as in claim 13 wherein the foot members are glazed and the handle member is not glazed.

15. A massage tool as in claim 14 wherein the ceramic material contains a strengthening compound.

16. A massage tools as in claim 15 wherein the strengthening compound is aluminum oxide.

17. A method of making a massage tool having rubbing surfaces comprising the following steps:

molding a clay into the shape of the massage tool of claim 1;

baking the clay;

glazing the clay on the rubbing surfaces of the massage tool.

* * * * *